United States Patent [19]

May et al.

[11] Patent Number: 4,881,288

[45] Date of Patent: Nov. 21, 1989

[54] CENTER FEED DISPENSER FOR CLEANING SOLUTION

[75] Inventors: Barry A. May, North Tonawanda, N.Y.; James Armstrong, Lewiston, N.Y.

[73] Assignee: Tennant Trend Inc., Niagara Falls, N.Y.

[21] Appl. No.: 218,631

[22] Filed: Jul. 13, 1988

[51] Int. Cl.[4] ..... A47L 11/34

[52] U.S. Cl. ..... 15/98; 15/50 R; 15/320; 134/6; 221/1

[58] Field of Search ..... 15/29, 50 R, 98, 320, 15/321; 134/6; 222/1, 205, 544, 630

[56] References Cited

U.S. PATENT DOCUMENTS

| | | | |
|---|---|---|---|
| 1,931,893 | 10/1933 | Fleming et al. | 15/29 |
| 2,800,313 | 7/1957 | Targosh et al. | 15/29 X |
| 2,879,528 | 3/1959 | Finnell | 15/50 R |
| 3,325,844 | 6/1967 | Lampe | 15/50 R |
| 3,375,540 | 4/1968 | Hyde | 15/320 |
| 3,501,798 | 3/1970 | Carraro | 15/320 |
| 3,720,977 | 3/1973 | Brycki | 15/321 |
| 3,943,591 | 3/1976 | Lanusse | 15/29 |
| 4,510,643 | 4/1985 | Kitada | 15/320 |
| 4,590,635 | 5/1986 | Tucker | 15/50 R |

*Primary Examiner*—Edward L. Roberts

*Attorney, Agent, or Firm*—Kinzer, Plyer, Dorn, Mceachran & Jambor

[57] ABSTRACT

In a machine which cleans or buffs a floor by rotating a cleaning or buffing pad against the floor at high speed, simplified means are disclosed for supplying a controlled amount of cleaning fluid to the floor at the center of the cleaning pad. Vacuum which is created within the pad housing by the centrifugal action of the cleaning pad draws cleaning fluid out of a reservoir and into the central region of the pad. Flow is controlled and flow rate is set by limiting atmospheric vents. There is precisely controlled flow to the center of the pad, which may be continuous or on demand, no pump or moving parts of any kind are required, and the system is self-cleaning.

12 Claims, 2 Drawing Sheets

CENTER FEED DISPENSER FOR CLEANING SOLUTION

BACKGROUND OF THE INVENTION

Commercial establishments such as stores, restaurants, schools, hospitals and the like have a strong incentive to maintain clean, attractive floors, and considerable time and effort are expended toward that end. Ceramic or plastic tile floors are typical in such places, and a regular schedule of maintenance is used to keep them gleaming. Commonly a protective coating is applied to the tile to enhance its appearance, and when it becomes dingy it is stripped off by chemical means and a new coating is applied. This is expensive and time-consuming, so measures are taken to prolong to the maximum the time between recoatings.

A schedule of floor maintenance which is often followed consists of scrubbing daily with cleaning solution and/or finish enhancers using an automatic scrubber, burnishing daily, applying mop-on restorer once a week, applying a coat of finish every fourth week, then stripping and re-coating every four to six months. Two machines are required; a scrubber and a burnisher. The scrubber is complicated to operate, requiring training for chemical mixes. This is difficult when employee turnover is high. Scrubbers are also labor intensive, usually requiring one person to operate the machine and another to go behind with a mop and bucket to pick up water spills.

A substantial decrease in labor and training and an increase in the time between re-coatings can be obtained if the floor is cleaned as needed, which may be daily, using a small amount of liquid cleaner in a machine equipped with a suitable cleaning pad, after which the cleaning pad is replaced with a buffing pad and the floor is dry buffed. The cleaner may incorporate a percentage of thinned down floor finisher, which helps maintain the original finish. Then if the heavy traffic areas are occasionally touched up with a finish restorer, the time between re-coatings may often be extended to as much as a year.

The periodic cleaning, which often must be done on a daily basis, has posed problems. The cleaning solutions must be dispensed evenly, but at a very low rate, on the order of one gallon per 20,000 to 40,000 square feet of floor as an example, depending on the particular cleaner used, the condition of the floor, etc. Available equipment has not been entirely satisfactory in accomplishing this. There are basically three types of dispensers used in the industry today:

Manual sprayer—a hand pump and a bottle. Each time that cleaner is needed the operator must manually pump the cleaning solution out of the bottle.

Pressurized sprayer—a hand pump which pressurizes a bottle which holds the cleaning solution. Some type of valve is required to release the cleaning solution out of the bottle when needed.

Electric pump—an electric pump which pumps the cleaner out of a bottle when required. An on-off pump switch is commonly used for dispensing solution when needed.

All these dispensers require the operator to repeatedly operate a control and use judgment as to how long to use it to dispense the very small amount of cleaner required, and they dispense the cleaner in batches rather than continuously, which can affect performance adversely. Also, they all have the complexity of requiring some form of pump.

SUMMARY OF THE INVENTION

The present invention overcomes the shortcomings of the currently available equipment. A high speed floor machine is used in which either a cleaning pad or a buffing pad can be quickly and easily interchanged so one machine can serve in both the cleaning mode and the buffing mode. Vacuum is created within the pad housing, for example, in the manner which is explained in detail in co-pending patent application Ser. No. 99,542, assigned to the present assignee, and which is incorporated here by reference. In the cleaning mode the vacuum draws cleaning solution out of a bottle or container and delivers it into the central portion of the cleaning pad. A channel through the pad hub conducts the fluid down to the floor level, and the pad centrifuges it outwardly, in the process cleaning the floor much better than can be done when the solution is introduced ahead of the pad, where only the rim of the pad can act on it. This outward flow under the pad also serves to clear the pad of residue from the floor, so it tends to not load up as pads sometimes do that are fed solution at their peripheries. Within convenient reach of the operator is an open air bleed for the vacuum system. He can close it simply by placing his thumb over it, which will cause solution to flow, or he can leave it open, which will stop the solution flow and purge the solution out of the lines. Another air bleed which may be variable may be set to closely control the rate of flow. No pump is needed, and there are no moving parts. Therefore, when supplying cleaning solution to a compatibly designed floor machine, the invention will achieve the following objectives:

Accurately meter and supply a continuous flow of cleaning solution at a very low rate, for example on the order of one gallon of cleaner for every 20,000 to 40,000 square feet of floor cleaned.

Serve as a continuous feed system or supply chemicals as needed for spot cleaning and finish restoration.

Feed cleaning solution to the center of the cleaning pad

- To utilize all of the pad contact area instead of only the outer one inch or so as is common when solution is fed to the front of a pad.
- To flush chemical buildup out of the pad.
- To help contain the solution in the burnisher head area.
- Eliminate problems of chemical buildup in lines, seals, and spray nozzles.
- Have no moving parts.
- Be reliable and long lasting in service.
- Be lower in cost than previous systems.

BRIEF DESCRIPTION OF THE PREFERRED EMBODIMENT

Figure 1:
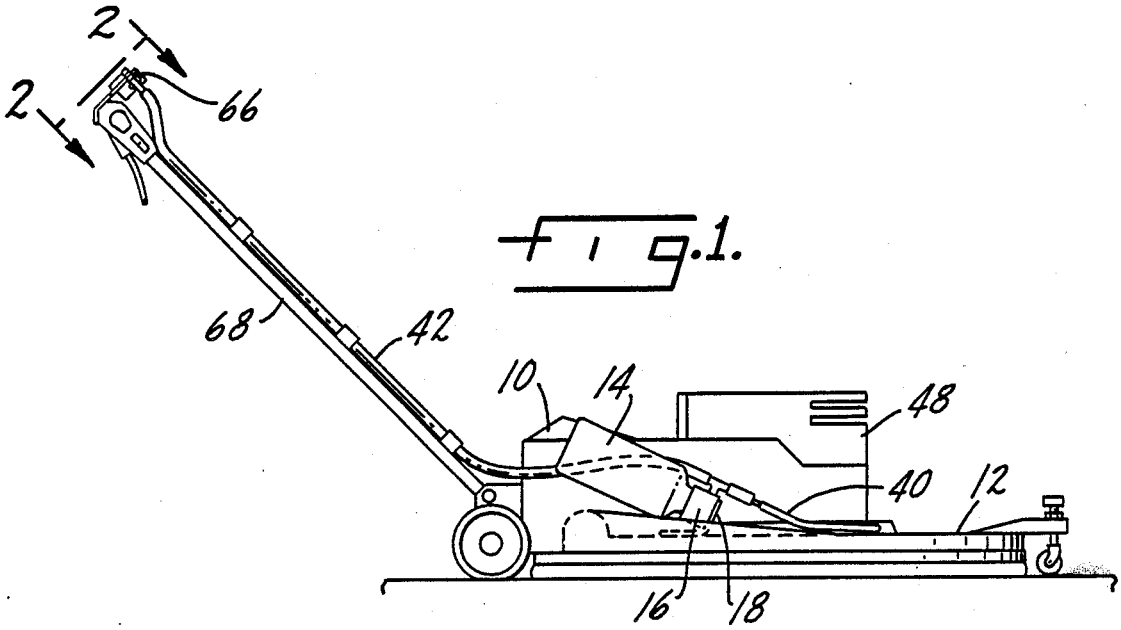
FIG. 1 is a side view of a floor machine which uses the present invention.

In the drawings, 10 may be a floor machine of the type disclosed in co-pending Pat. Application Ser. No. 99,542. It is capable of operating either a cleaning pad or a burnishing pad at a high speed, for example on the order of 1500 to 2500 rpm, on a floor surface to be cleaned. The centrifugal action of its pad creates a vacuum within its pad housing 12, as discussed in detail in the above patent application.

Cleaner Solution Reservoir

Mounted on the upper surface of the pad housing 12 is a bottle 14 or the like, which may be made of glass, a suitable plastic, or metal, and which serves as a reservoir for a supply of cleaning fluid. There are various cleaners available, and this equipment will handle many of them. The bottle or container is screwed into or otherwise suitable connected to a nylon bottle cap 16, which is attached to a bracket 18 that is mounted on the flat upper surface of the pad housing 12. Thus the bottle or container is mounted on the machine and is inclined at an angle 20.

Bottle cap 16 may have a standard bottle thread in an aperture 22 to accept bottle 14. This aperture is connected with an outlet port 24 and an air supply vent 26. In the container 14 is a supply of liquid cleaner 28, which stands at a level 30 in the bottle and a level 32 in the air supply vent. A tee fitting 34 is screwed into the outlet port. Attached to one branch of the tee is a short length of preferably flexible plastic tubing 36, into which is pressed reducing tube connector 38. To this may be attached a flexible tube 40 which leads to the center of the pad housing. Attached to the other branch of tee 34 is a length of flexible tubing 42 which goes to the operator's controls.

Center Feed to the Cleaning Pad

Figure 5:
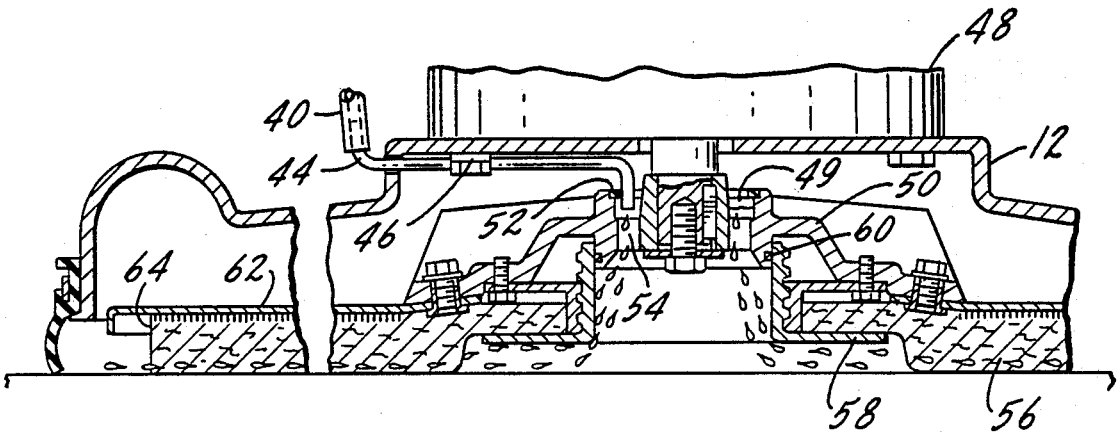
FIG. 5 is a partial section through the pad housing, showing the means for admitting cleaning fluid to the center of the cleaning pad.

Flexible tube 40, which is shown as pressed over connector 38, is attached at its opposite end to a metal tube 44, as seen in FIG. 5. Metal tube 44 passes through a snugly fitting hole in pad housing 12, and is secured to the under side of the housing by a clip 46 or the like which is welded to the tube and may be held under on of the bolts which attach the pad driving motor 48 to the housing. The free end of metal tube 44 leads to a point near the center of the pad housing, where it is bent down to deliver cleaning fluid into an annular trough 49 in the pad driver hub 50. Ring 52 is pressed or otherwise fitted into a shallow counterbore at the top of hub 50 to prevent fluid from climbing up and out of the trough as the hub spins. A series of holes 54 in the bottom of annular trough 49 pass the fluid down to the central region of the cleaning pad 56. The pad is retained by a retainer flange nut 58. An O-ring or suitable seal 60 is set in a groove machined or otherwise formed in hub 50 to seal the flange nut 58 and prevent loss of fluid between it and the hub. Flexible driving disc 62 is bolted or otherwise suitably connected to drive hub 50, and provides rotary drive to the cleaning pad through a Velcro-like surface 64 which engages the fibers of the cleaning pad.

Floor Cleaning Action

The centrifugal action of the rapidly spinning pad exhausts air from under the housing and creates a vacuum within the housing, for example as explained in the above referenced patent application. This vacuum sucks cleaning fluid into the housing through tube 44, from which it drops into the annular trough in the pad driver hub, through the holes in the bottom of the trough, and down through the center hole of the cleaning pad to the floor. There it is centrifuged out under the pad and cleans the floor. Soilage from the floor is emulsified by the cleaner and suspended in it. The quantity of cleaner is so small that it does not form puddles on the floor, but dries behind the floor machine. A subsequent dry burnishing operation removes the dried cleaner and emulsified soilage and deposits the material as a powder in the dust bag of the machine, leaving a gleaming finish on the floor.

Flow Controls

Figure 2:
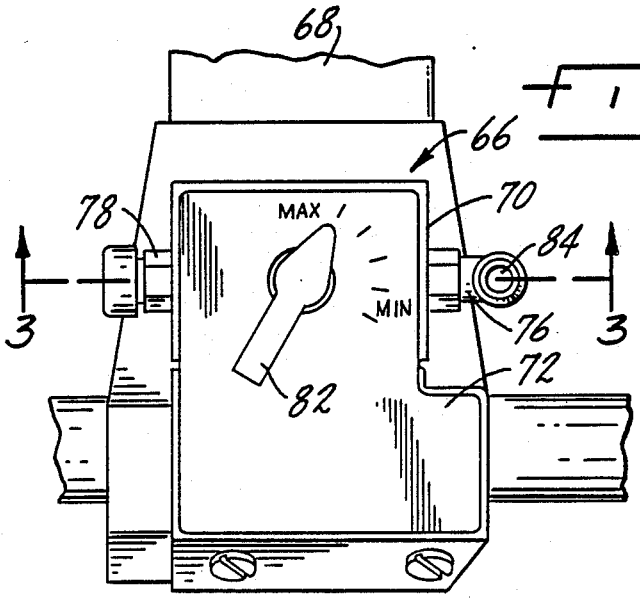
FIG. 2 is a view on an enlarged scale of the cleaner fluid flow controls taken along line 2—2 of FIG. 1.
Figure 3:
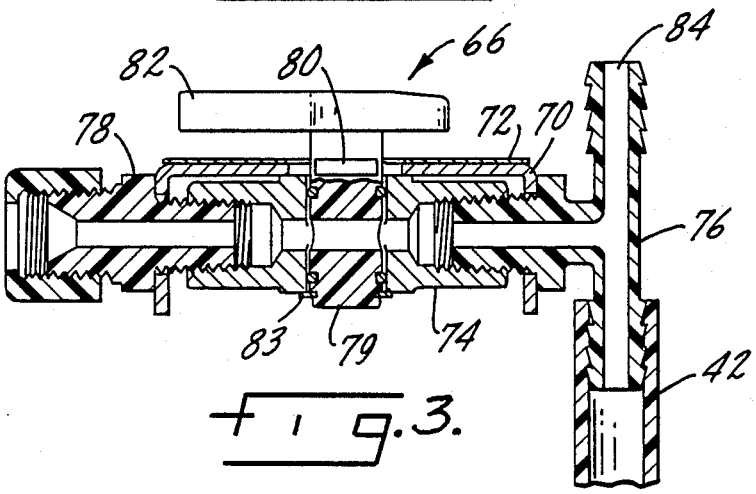
FIG. 3 is a cross section on an enlarged scale of the cleaner fluid flow controls taken along section line 3—3 of FIG. 2.
Figure 4:
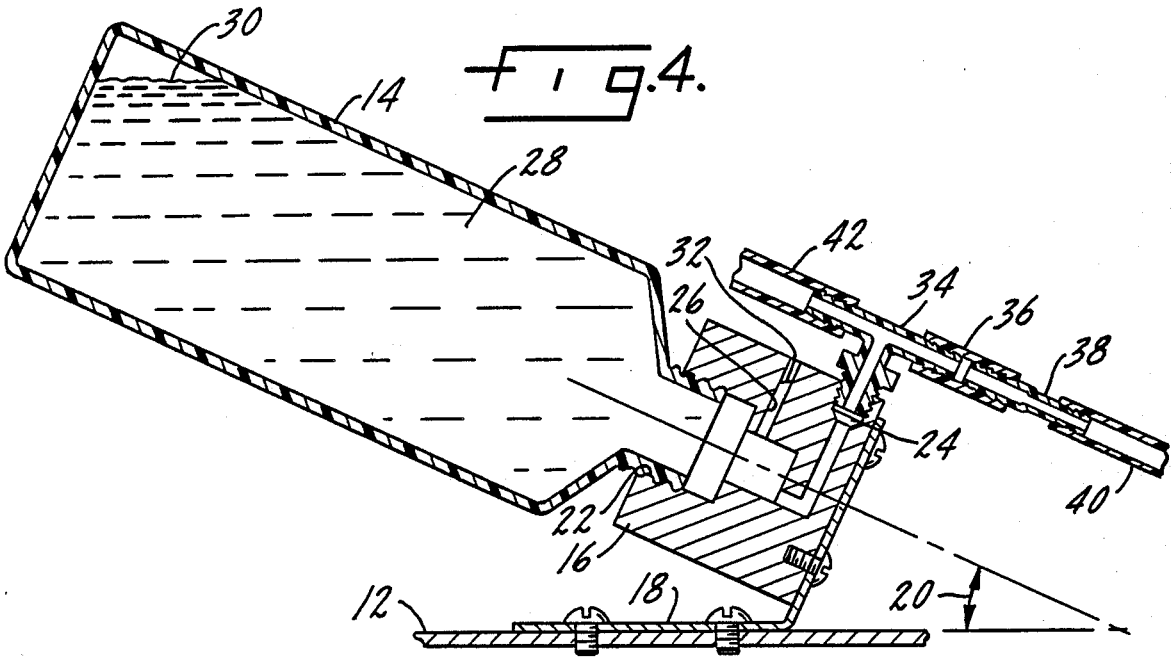
FIG. 4 is longitudinal section through the cleaner fluid reservoir and air supply vent.

Controls 66 for the cleaner flow are shown as located in the upper end of the handle 68. As seen in FIGS. 2 and 3, a bracket 70 which is attached to the handle may have an instruction decal 72 bonded to its upper surface. A plug valve 74 or the like has tee fitting 76 screwed into its one end and straight fitting 78 screwed into its other end. The valve as shown is a plug valve. However, other types of valves could be used, e.g. a ball valve or a needle valve. The valve stem 79 projects outwardly, as at 80, through a hole in the bracket and decal, and this plus the two fittings 76 and 78 secure the valve to the bracket. The top of the valve stem is formed into a valve handle 82, which is integral with the stem 79. Stem 79 fits into valve body 74 and is held by a snap ring 83. It may be positioned to open or close the valve completely or set it at any intermediate position. These valve settings correspond to flow rates from minimum to maximum, and are indicated on the decal 72. The open end 84 of tee 76 is known as the thumb hole, and is located in a position where the operator can conveniently cover it with his thumb if he wishes.

The use, operation and function of the invention are as follows: Bottle 14 is removed from the machine and filled with cleaning fluid. Alternatively, the bottle may be a disposable, pre-filled unit. In either case it is then installed by screwing or other wise connecting it to bottle cap 16. In the particular form of machine shown, this may be done without spilling fluid by rocking the machine back on its handle and tilting the pad housing up. The machine is then placed on the floor to be cleaned and the motor started so the pad spins up to speed.

Vacuum will be created under the pad housing, and will apply suction to the tubing lines 40 and 42. If the operator places his thumb over thumb hole 84 and holds it there, suction will be applied to bottle 14. It will suck fluid out of the bottle until the fluid level 30 in the bottle drops enough to create an equalizing vacuum in the bottle. Flow from the bottle will then stop, but the suction will then lower the liquid level 32 in an air supply vent 26, allowing air to enter. When the fluid level is pulled down low enough an air bubble will enter bottle 14, reducing the vacuum above fluid level 30, and allowing more fluid to be drawn out of the bottle and into the pad housing. This action will be repeated as long as the operator keeps his thumb on the thumb hole. The intensity of the vacuum and therefore the rate of flow of the cleaning fluid can be adjusted with valve 74. Setting it fully closed creates the maximum vacuum and maximum fluid flow. Setting it fully open allows some air to enter the system and reduces the vacuum so that only a very small amount of fluid will be dispensed.

Intermediate valve settings give intermediate flow rates. Also, various cleaning fluids may vary in their viscosities. Adjusting valve 74 can compensate for differences in viscosity and permit the desired rate of fluid dispensing with various fluids.

When the operator removes his thumb from the thumb hole, so much air is bled into the system that no fluid is pulled from the bottle. In this case, air is pulled through tube 42 into tubes 40 and 44, purging them of any residual cleaning fluid that may be left in them. Thus, there is no problem with lines becoming clogged with dried chemicals, as sometimes happens with other floor machines. The system works well for continuous dispensing of cleaning fluid, as when cleaning large floor areas. It also works well for intermittent dispensing, as for spot cleaning of soiled areas.

Several factors are significant. When bottle 14 is full and the machine is not running, the gravity head of fluid in the bottle should not cause overflow out of air supply vent 26. Therefore the bottle is mounted at as low an angle 20 as will allow nearly all the fluid in the bottle to flow out 25 degrees works well in the present model. The height of air supply vent 26 should then be made great enough to prevent overflow with a full bottle. Making bottle cap 16 on the order of three inches in diameter gives adequate standpipe height in vent 26 when the bottle is a one-quart size. These are only examples applicable to the present model.

Tube 42 needs to be large enough in diameter that it will pass air freely when the machine is running and the thumb hole is uncovered. Three-eighths inch inside diameter has been found to be adequate. Much less than that will cause some flow of fluid even when the thumb hole is uncovered.

Tube 40 should be somewhat smaller so it will fill quickly and empty quickly at the start and end of dispensing. If it is too small, however, it will impede the flow of fluid if that fluid is viscous to any degree. Three-sixteenths inch inside diameter has been found to work well.

Whereas the preferred form and several variations of the invention have been shown, described, and suggested, it should be understood that suitable additional alterations, changes, substitutions and variations may be made without departing from the invention's fundamental theme. For example, throughout the system has been referred to as functioning in response to a vacuum. But it should be understood that air pressure differential would possibly be a more appropriate term in that certain aspects of a positive air pressure — above atmospheric — might also be usable. This is to say that the exhaust from the housing 12 might be used either alone or in combination with the vacuum created in the center of the pad to augment or supplement the various functions involved. Also, the particular angle mounting of the bottle or container 14 has been found quite effective in the present unit, but variations thereon could and probably would be made dependent upon the particular model or installation. With these and other variations in mind it is desired that the inventive subject matter be unrestricted except by the appended claims.

I claim:

The embodiments of the invention in which an exclusive property or privilege is claimed are defined as follows:

1. In a cleaning machine for removing soilage from a surface, a mobile frame, a rotary cleaning element on the frame for working on the surface and power means for rotating it, the rotary cleaning element being constructed and arranged so that, when rotated at a relatively high speed, it will create an air pressure differential, a source of cleaning solution on the frame, and a connection between the cleaning solution source and the air pressure differential so that the air pressure differential causes cleaning solution to be supplied from the source to the center of the rotary cleaning element.

2. The structure of claim 1 further characterized in that the rotary cleaning element is a disc pad.

3. The structure of claim 1 further characterized in that the connection between the cleaning solution source and the air pressure differential extends to the inside of the cleaning element.

4. The structure of claim 1 further characterized in that the cleaning machine has a handle extending upwardly therefrom for operator manipulation and further including a control on the handle operable by the operator for controlling the flow of cleaning solution to the rotary cleaning element.

5. The structure of claim 4 further characterized in that the control on the handle includes an on/off control and further including a modulating control operable by the operator for varying the fluid flow during the "on" cycle.

6. A method of supplying cleaning solution from a source to a rotary disk type cleaning tool which is adapted to engage a surface to be cleaned, including the steps of rotating the tool in a manner that creates an air pressure differential, communicating the solution source to the tool so that the air pressure differential created by the tool will tend to cause the cleaning solution to flow from the source to the tool, and venting the air pressure differential when supply of solution to the tool is not desired.

7. The method of claim 6 further characterized by and including the step of modulating the venting step so that the solution will be supplied to the tool at a selected rate.

8. The method of claim 6 further characterized in that the communicating step includes supplying the solution to the center of the cleaning tool.

9. In a floor cleaning machine, a frame, a source of sub-atmospheric air pressure on the frame, a passage in communication with the source of sub-atmospheric air pressure, a cleaning solution container on the frame in communication with the passage below the level of solution in the container so that cleaning solution may pass from the container to the passage and the sub-atmospheric air pressure will be communicated to the container below the level of solution in the container, and an airbleed passage in the frame open to atmosphere and in communication with the interior of the container below the level of solution to the container so that the vacuum in the container caused by the outflow of cleaning fluid from the container will be automatically relieved from time to time by atmospheric air admitted through the airbleed passage in response to the subatmospheric pressure within the container.

10. The structure of claim 9 further characterized in that the container is removably mounted on the frame.

11. In a floor cleaning machine, a frame, a cleaning tool on the frame, a sub-atmospheric air pressure source on the frame, a passage ex tending to the cleaning tool and in communication with the sub-atmospheric air pressure source, an otherwise closed cleaning solution container on the frame with the lower portion thereof in communication with the passage so that the sub-atmospheric air pressure source will be communicated to the interior of the container, and an airbleed passage in the frame open to atmosphere and in communication with the lower portion of the interior of the container so that the vacuum caused by the outflow off cleaning fluid from the inverted container will be automatically relieved from time to time by atmospheric air through the airbleed passage.

12. The structure of claim 11 further characterized in that the container is removably mounted on the frame, and further including means mounting the container on the frame at an angle to and above the horizontal when the machine is in operative position and at an angle to and below the horizontal when the container is being mounted on the frame, the container being moved between its operating and its mounting positions by the machine being tipped a certain amount.

* * * * *